US010330098B2

(12) United States Patent
Ohta et al.

(10) Patent No.: US 10,330,098 B2
(45) Date of Patent: Jun. 25, 2019

(54) SCROLL COMPRESSOR WITH CONTROLLED PRESSING FORCE

(71) Applicant: MITSUBISHI HEAVY INDUSTRIES THERMAL SYSTEMS, LTD., Tokyo (JP)

(72) Inventors: Masahiro Ohta, Tokyo (JP); Makoto Takeuchi, Tokyo (JP); Kazuhide Watanabe, Kiyosu (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 50 days.

(21) Appl. No.: 15/321,626

(22) PCT Filed: May 11, 2015

(86) PCT No.: PCT/JP2015/002376
§ 371 (c)(1),
(2) Date: Dec. 22, 2016

(87) PCT Pub. No.: WO2015/198516
PCT Pub. Date: Dec. 30, 2015

(65) Prior Publication Data

US 2017/0159658 A1 Jun. 8, 2017

(30) Foreign Application Priority Data

Jun. 27, 2014 (JP) ..... 2014-132559

(51) Int. Cl.
*F03C 2/00* (2006.01)
*F03C 4/00* (2006.01)
(Continued)

(52) U.S. Cl.
CPC ..... *F04C 18/0269* (2013.01); *F01C 17/063* (2013.01); *F04C 18/02* (2013.01);
(Continued)

(58) Field of Classification Search
CPC ..... F04C 18/02; F04C 18/0215; F04C 18/0246; F04C 18/0269; F04C 27/001;
(Continued)

(56) References Cited

U.S. PATENT DOCUMENTS 6,312,235 B1 * 11/2001 Takeuchi ..... F01C 17/063 418/55.1
2009/0169406 A1 * 7/2009 Ueno ..... F01C 21/10 418/55.6
(Continued)

FOREIGN PATENT DOCUMENTS

JP 9-32752 A 2/1997
JP 09126161 A * 5/1997 ..... F04C 18/0215
(Continued)

OTHER PUBLICATIONS

JP 09126161 A—Oshima, Kenichi—Scroll Compressor—May 1997—English Translation.*
(Continued)

*Primary Examiner* — Theresa Trieu
(74) *Attorney, Agent, or Firm* — Birch, Stewart, Kolasch & Birch, LLP

(57) ABSTRACT

A scroll compressor, includes: a scroll compression mechanism including an orbiting scroll, a fixed scroll, and a thrust plate supporting a load of the orbiting scroll in a thrust direction; a back-pressure application mechanism that applies, as back pressure, the refrigerant gas compressed by the scroll compression mechanism to a rear surface of the thrust plate; and a floating amount restriction mechanism that restricts an amount of floating of the thrust plate caused by the back pressure. The floating amount restriction mechanism includes a restriction pin that includes a shaft part and a head part, and locks the thrust plate to the head part to restrict the amount of floating. The shaft part passes through the thrust plate and has a front end part fixed to a front
(Continued)

housing, and the head part has a diameter larger than a diameter of the shaft part.

7 Claims, 8 Drawing Sheets

(51) Int. Cl.
*F04C 18/00* (2006.01)
*F04C 18/02* (2006.01)
*F01C 17/06* (2006.01)
*F04C 27/00* (2006.01)

(52) U.S. Cl.
CPC ..... *F04C 18/0215* (2013.01); *F04C 27/001* (2013.01); *F04C 2230/602* (2013.01); *F04C 2230/91* (2013.01)

(58) Field of Classification Search
CPC F04C 27/005; F04C 2230/91; F04C 2230/92; F04C 2230/602; F01C 17/066; F01C 19/08; F01C 19/10
USPC ..... 418/55.1–55.6, 57, 142, 178–179; 464/102
See application file for complete search history.

(56) References Cited

U.S. PATENT DOCUMENTS

| | | | | |
|---|---|---|---|---|
| 2014/0093413 | A1 | 4/2014 | Stone et al. | |
| 2014/0369819 | A1* | 12/2014 | Yamashita ..... | F04C 18/0215 29/888.02 |

FOREIGN PATENT DOCUMENTS

| | | | |
|---|---|---|---|
| JP | 3241575 | B2 | 12/2001 |
| JP | 2003-35283 | A | 2/2003 |
| JP | 3893487 | B2 | 3/2007 |
| JP | 2012-229650 | A | 11/2012 |
| JP | 2013-241862 | A | 12/2013 |

OTHER PUBLICATIONS

Office Action dated Mar. 6, 2018 in counterpart JP Application No. 2014-132559 with an English Translation.

* cited by examiner

SCROLL COMPRESSOR WITH CONTROLLED PRESSING FORCE

TECHNICAL FIELD

The present invention relates to a scroll compressor.

BACKGROUND ART

A scroll compressor used in a vehicle air conditioner includes a fixed scroll and an orbiting scroll. Each of the fixed scroll and the orbiting scroll is configured of a spiral wrap that is integrally formed on one surface of a disc-like end plate. The fixed scroll and the orbiting scroll face each other while the respective wraps are engaged with each other, to cause the orbiting scroll to revolve relative to the fixed scroll. Then, a compression space formed between the respective wraps is reduced in capacity while the compression space is caused to move from the outer periphery side to the inner periphery side, thereby resulting in compression of a refrigerant. Note that the mechanism that relates to the compression of the refrigerant and includes the fixed scroll and the orbiting scroll is also referred to as a scroll compression mechanism.

During operation of the scroll compressor, the orbiting scroll and the fixed scroll each receive force, in a direction separating from each other, from the compressed refrigerant, and the orbiting scroll accordingly moves in an axial direction. As a result, a gap is formed between a front end surface (a tooth top) of the wrap of each scroll and the end plate on the opposite side, and the refrigerant is leaked from the gap, which may deteriorate performance of the compressor.

Therefore, for example, as disclosed in Patent Literature 1, it has been proposed that, to prevent the orbiting scroll from moving during the operation of the compressor, the compressed refrigerant is applied to the rear surface of the orbiting scroll to cause the orbiting scroll to float, thereby controlling the front end surface of the wrap to be constantly brought into contact with the end plate on the opposite side. Note that the control is also referred to as orbiting back-pressure control.

CITATION LIST

Patent Literature

Patent Literature 1: Japanese Patent No. 3893487
Patent Literature 2: Japanese Patent Laid-Open No. 8-86287
Patent Literature 3: Japanese Patent Laid-Open No. 8-159051

SUMMARY OF INVENTION

Technical Problem

When the orbiting scroll is floated, however, a thrust load from the orbiting scroll is received by a tooth top of the wrap. Thus, when the pressure applied as the back pressure becomes excessively large, pressing force of the tooth top of the wrap with respect to the end plate on the opposite side also becomes excessively large, which may cause the tooth top of the wrap to seize to the end plate or to be damaged.

The present invention is made based on such problems, and an object of the present invention is to provide a scroll compressor that makes it possible to avoid occurrence of excessive pressing force on a tooth top of a wrap while adopting orbiting back-pressure control.

Solution to Problem

A scroll compressor of the present invention made for such a purpose includes: a scroll compression mechanism; a back-pressure application mechanism; a floating amount restriction mechanism; and a housing that houses the scroll compression mechanism, the back-pressure application mechanism, and the floating amount restriction mechanism.

The scroll compression mechanism according to the present invention includes an orbiting scroll, a fixed scroll that faces the orbiting scroll to form a compression chamber compressing refrigerant gas, and a thrust plate supporting a load of the orbiting scroll in a thrust direction.

The back-pressure application mechanism applies, as back pressure, the refrigerant gas compressed by the scroll compression mechanism to a rear surface of the thrust plate.

The floating amount restriction mechanism restricts an amount of floating of the thrust plate caused by the back pressure.

In the scroll compressor according to the present invention, the back-pressure application mechanism applies, as the back pressure, the refrigerant gas compressed by the scroll compression mechanism to the rear surface of the thrust plate. This causes the thrust plate to float, thereby causing the orbiting scroll to float. Then, the scroll compressor according to the present invention restricts the amount of floating of the orbiting scroll through the restriction of the amount of floating of the thrust plate by the floating amount restriction mechanism. Therefore, it is possible to avoid occurrence of excessive pressing force on the tooth top of the wrap.

In the scroll compressor according to the present invention, the floating amount restriction mechanism may include a restriction pin that has a shaft part and a head part, and locks the thrust plate to the head part to restrict the amount of floating. The shaft part passes through the thrust plate and has a front end part fixed to the housing. The head part is continuous to the shaft part and has a diameter larger than a diameter of the shaft part. The head part may be locked to a step of a restriction hole that passes through the thrust plate and into which the restriction pin is inserted.

A pin-ring rotation preventing mechanism that prevents rotation of the orbiting scroll may be provided as the restriction pin, and the rotation preventing pin may function as the restriction pin.

In the scroll compressor according to the present invention, the floating amount restriction mechanism restricts the amount of floating through locking of a peripheral edge of the thrust plate to an inner circumferential wall of the housing.

In the scroll compressor according to the present invention, an abradable coating may be preferably provided on a front end surface of one or both of the wrap provided in the orbiting scroll and the wrap provided in the fixed scroll. Providing the abradable coating makes it possible to relax the dimensional tolerance required for members relating to the floating amount restriction of the orbiting scroll.

Advantageous Effects of Invention

The present invention provides the scroll compressor that makes it possible to avoid occurrence of excessive pressing force on the tooth top of the wrap while adopting the orbiting back-pressure control.

BRIEF DESCRIPTION OF DRAWINGS

FIG. 3A is a diagram illustrating a restriction pin and a restriction hole formed on a thrust plate, FIG. 3B is a diagram illustrating a state in which a floating amount of the thrust plate is zero, and FIG. 3C is a diagram illustrating a state in which the floating amount of the thrust plate is the maximum.

FIG. 5A is a diagram illustrating a restriction pin and a restriction hole formed on a thrust plate, FIG. 5B is a diagram illustrating a state in which a floating amount of the thrust plate is zero, and FIG. 5C is a diagram illustrating a state in which the floating amount of the thrust plate is the maximum.

FIG. 7A is a diagram illustrating a state in which a floating amount of a thrust plate is zero, and FIG. 7B is a diagram illustrating a state in which the floating amount of the thrust plate is the maximum.

DESCRIPTION OF EMBODIMENTS

The present invention is described in detail below based on some embodiments illustrated in accompanying drawings.

First Embodiment

Figure 1:
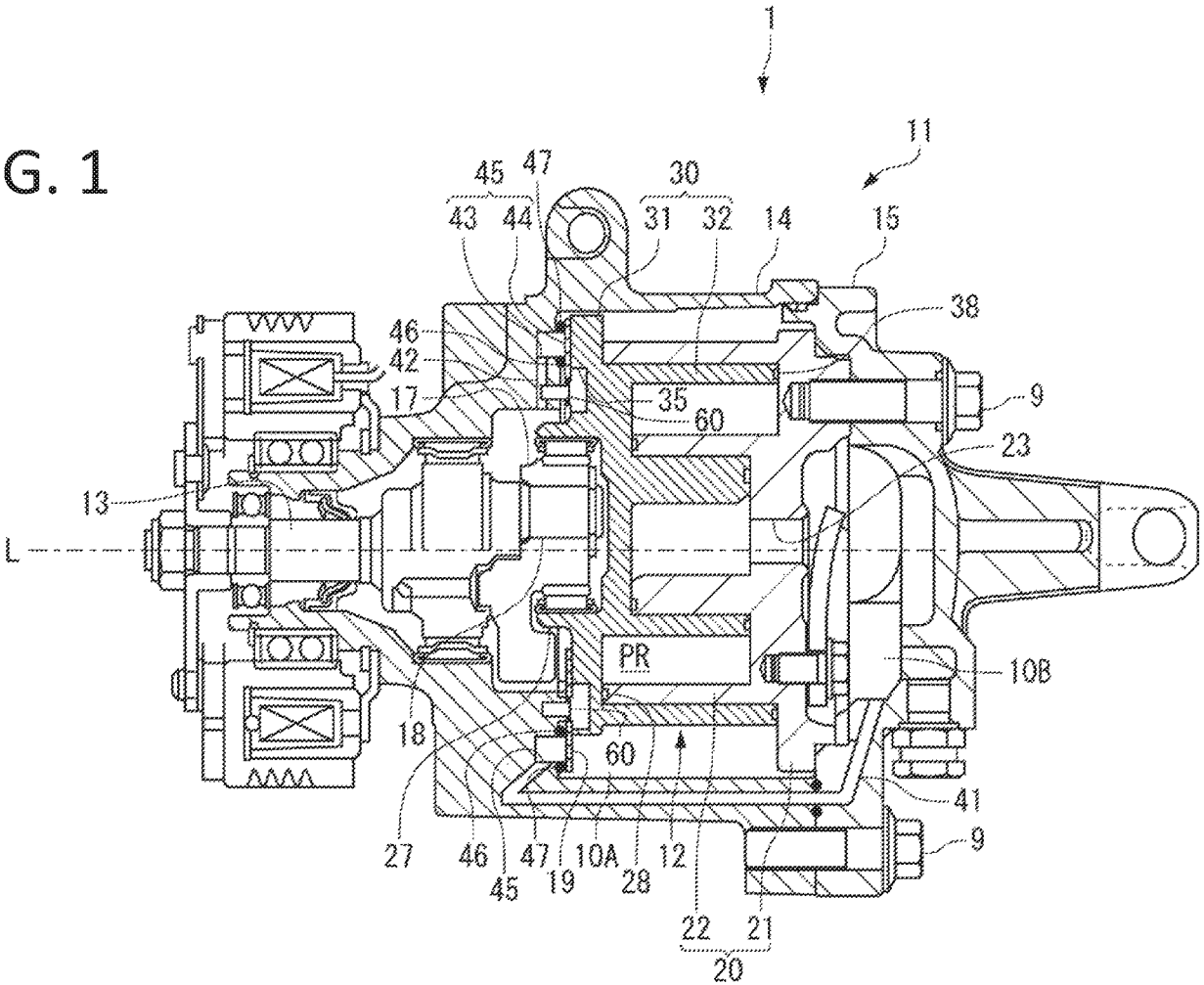
FIG. 1 is a vertical cross-sectional view of a scroll compressor according to a first embodiment.

As illustrated in FIG. 1, a horizontal scroll compressor (hereinafter, a compressor) 1 according to the present embodiment includes, as main components: a housing 11; a scroll compression mechanism (hereinafter, a compression mechanism) 12 that is disposed inside the housing 11 and compresses refrigerant gas taken in the housing 11; and a main shaft 13 that drives the compression mechanism 12. The compressor 1 compresses a refrigerant and provides the compressed refrigerant to, for example, a refrigerant circuit of a vehicle air conditioner.

The compressor 1 has a configuration that makes it possible to avoid occurrence of excessive pressing force on a tooth top of a wrap while adopting orbiting back-pressure control. In the following, the configuration of the compressor 1 is described.

[Housing 11]

The housing 11 includes a front housing 14 and a rear housing 15. Tightening flanges are provided on a plurality of positions on a circumference of each of the front housing 14 and the rear housing 15, and are integrally tightened and fixed by fasting members 9.

The compression mechanism 12 described below is housed in a housing space that is formed by combination of the front housing 14 and the rear housing 15. Note that, in the compressor 1, side on which the front housing 14 is provided is referred to as front, and side on which the rear housing 15 is provided is referred to as rear.

[Compression Mechanism 12]

The compression mechanism 12 includes a fixed scroll 20 that is fixed to the housing 11, and an orbiting scroll 30 that revolves relative to the fixed scroll 20. Further, an inside of the housing 11 is partitioned into a low pressure chamber 10A and a high pressure chamber 10B by the compression mechanism 12.

The fixed scroll 20 is provided such that a center axis thereof is coincident with a center axis L of the main shaft 13, and forms a compression chamber PR together with the orbiting scroll 30.

The fixed scroll 20 includes a fixed end plate 21 supported by the rear housing 15, and a spiral wrap 22 that stands from one of surfaces of the fixed end plate 21.

A discharge port 23 that passes through in an axial direction is provided on a center part of the fixed end plate 21. The high pressure/high temperature refrigerant gas that has been compressed in the compression chamber PR flows into the high pressure chamber 10B through the discharge port 23. The refrigerant gas contains a lubricant oil that lubricates a sliding surface and a bearing of the fixed scroll 20 and the orbiting scroll 30.

A chip seal 28 is provided on a front end surface of the wrap 22 in order to secure sealability between the front end surface of the wrap 22 and an orbiting end plate 31 of the orbiting scroll 30 on the opposite side facing the front end surface. The chip seal 28 is slid while being brought into contact with the orbiting end plate 31 of the orbiting scroll 30 through the lubricant oil, thereby sealing a gap that is formed between the front end surface of the wrap 22 and the orbiting end plate 31. The gap necessary for formation of an oil film of the lubricant oil is formed between the front end surface and the orbiting end plate 31.

An abradable coating may be formed, as a sealing member, on the front end surface of the wrap 22.

The abradable coating is worn when being brought into contact with the orbiting end plate 31 of the orbiting scroll 30 on the opposite side. This makes it possible to maintain the gap between the front end surface of the wrap 22 and the orbiting end plate 31 at the minimum level. In addition, it is possible to relax the dimensional tolerance required for a member relating to the floating amount restriction of the orbiting scroll 30 by a wearing amount of the abradable coating. Examples of the member relating to the floating amount restriction may include the restriction pin 60 described later, and a thrust plate 19 that has a restriction hole 65 into which the restriction pin 60 is inserted.

The material of the abradable coating is not limited, and may be selected from metal materials, resin materials, and ceramic materials. The abradable coating may also be provided on a wrap 32 of the orbiting scroll 30.

The orbiting scroll 30 includes the disc-like orbiting end plate 31 and the spiral wrap 32 that stands from one of surfaces of the orbiting end plate 31.

A boss 27 is provided on a rear surface of the orbiting end plate 31 of the orbiting scroll 30, and an eccentric bushing 17 is assembled to the boss 27 through a bearing. An eccentric pin 18 is fitted to the inside of the eccentric bushing 17. This couples the orbiting scroll 30 with the main shaft 13 while being eccentric from the shaft center of the main shaft 13. Accordingly, when the main shaft 13 rotates, the orbiting scroll 30 revolves at an orbiting radius that is an eccentric distance from the shaft center of the main shaft 13.

To prevent rotation of the orbiting scroll 30 while allowing revolution of the orbiting scroll 30, an Oldham's coupling not illustrated and a pin-ring rotation preventing mechanism are provided between the orbiting scroll 30 and the main shaft 13. The rotation preventing mechanism is provided on each of four positions illustrated by P1 in FIG. 2, and the configuration thereof is described in a second embodiment.

A chip seal 38 is provided on the front end surface of the wrap 32 as with the front end surface of the wrap 22, and an oil film of a lubricant oil is formed between the chip seal 38 and the fixed end plate 21.

The fixed scroll 20 and the orbiting scroll 30 are assembled to be eccentric from each other by a predetermined amount and to have a small gap in a wrap height direction between the front end surfaces and bottom surfaces of the respective wraps 22 and 32 that are engaged with each other with a phase shifted by 180 degrees. As a result, as illustrated in FIG. 1, the pair of compression chambers PR that are formed by the end plates 21 and 31 and the wraps 22 and 32 are formed, symmetrically to the scroll center, between the scrolls 20 and 30. Each of the compression chambers PR gradually moves toward an inner circumference along with the revolution of the orbiting scroll 30 while decreasing the volume of the compression chamber PR. Then, the refrigerant gas is compressed at the maximum level at the center part of the spiral.

The compression mechanism 12 decreases the capacity of the compression space that is formed between the scrolls 20 and 30, in the wrap height direction at the middle of the spiral, and is called a 3D scroll (R). Therefore, the height of the wrap is made lower on the inner peripheral side than that on the outer peripheral side on both of the fixed scroll 20 and the orbiting scroll 30. In addition, the end plate on the opposite side facing the stepped warp is made project toward the inner surface of the end plate on the inner peripheral side rather than the outer peripheral side.

Figure 8:
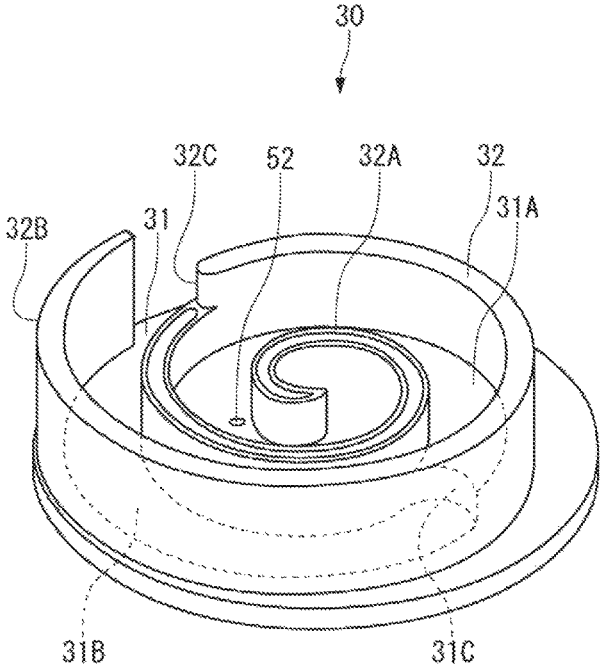
FIG. 8 is a perspective view of an orbiting scroll.

As illustrated in FIG. 8, a step part 32C is provided between an inner circumferential wrap 32A and an outer circumferential wrap 32B of the orbiting scroll 30. In the step part 32C, the outer circumferential wrap 32B stands up from the inner circumferential wrap 32A, and the outer circumferential wrap 32B has a height higher than that of the inner circumferential wrap 32A. In contrast, the end plate 31 includes an inner circumferential bottom part 31A and an outer circumferential bottom part 31B, and a step part 31C is provided therebetween, which causes the inner circumferential bottom part 31A to be higher in height than the outer circumferential bottom part 31B.

Note that the fixed scroll 20 also has a structure similar to the structure of the orbiting scroll.

Further, although the example of one step is illustrated in this case, two or more steps may be provided.

[Thrust Plate 19]

The annular thrust plate 19 is provided in front of the orbiting scroll 30 to be close to and to face the orbiting end plate 31.

The thrust plate 19 is formed of a wear resident material, is disposed between the orbiting end plate 31 and the front housing 14 that faces the orbiting end plate 31, and supports the thrust load from the orbiting scroll 30. The thrust plate 19 functions as a thrust sliding bearing relative to the orbiting scroll 30, and the orbiting scroll 30 slides on the thrust plate 19 during operation of the compressor 1.

The thrust plate 19 according to the present embodiment has a function of applying back pressure to the orbiting scroll 30, in addition to a function as the thrust sliding bearing as mentioned above. Movement of the thrust plate 19 in a circumferential direction is constrained; however, forward movement of the thrust plate 19 is not constrained in order to achieve back-pressure application function, and the thrust plate 19 can float from the front housing 14.

[Back-Pressure Application Mechanism]

The scroll compressor 1 has the following configuration in order to apply back pressure to the orbiting scroll 30 through the thrust plate 19.

Figure 2:
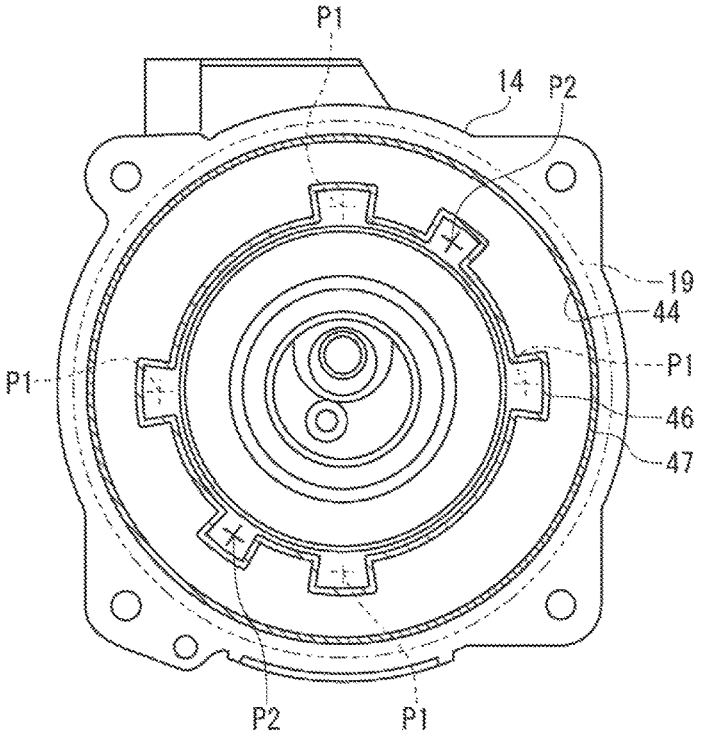
FIG. 2 is a diagram of a front housing of the scroll compressor as viewed from a front side thereof.

As illustrated in FIG. 2, an inner sealing body 46 and an outer sealing body 47 are provided between the thrust plate 19 and the front housing 14 with a distance therebetween in a radial direction. Each of the inner sealing body 46 and the outer sealing body 47 is formed of an elastic material. Further, an annular concave part 44 is provided between the inner sealing body 46 and the outer sealing body 47 along the circumferential direction of the front housing 14 (the thrust plate 19).

Further, as illustrated in FIG. 1, a communication passage 43 that communicates with the concave part 44 is annularly provided in the front housing 14. The concave part 44 and the communication passage 43 are together referred to as a pressure pocket 45. The communication passage 43 and the high pressure chamber 10B are communicated with each other by a high-pressure side flow path 41 that has an opening area A1. The high-pressure refrigerant gas discharged to the high pressure chamber 10B flows into the pressure pocket 45 through the high-pressure side flow path 41.

Note that, in the present embodiment, providing the inner sealing body 46 as close as possible to the center, except for the position P1 where the rotation preventing mechanism is provided and the position P2 where the floating amount restriction mechanism is provided, increases the opening area of the concave part 44. This makes it possible to secure the back pressure to be applied to the orbiting scroll 30.

The communication passage 43 communicates with an end of a low-pressure side flow path 42 having an opening area A2, and the other end of the low-pressure side flow path 42 communicates with the low pressure chamber 10A. Accordingly, the high pressure/high temperature refrigerant gas that has flowed from the high-pressure side flow path 41 into the pressure pocket 45 passes through the pressure pocket 45, and then flows into the low pressure chamber 10A through the low-pressure side flow path 42. Note that the refrigerant gas contains a lubricant oil, and the low-pressure side flow path 42 mainly functions as a passage returning the lubricant oil to the low pressure chamber 10A.

The opening area A2 of the low-pressure side flow path 42 is set to be smaller than the opening area A1 of the high-pressure side flow path 41 (A2<A1). Therefore, the amount of the refrigerant gas that flows from the pressure pocket 45 to the low pressure chamber 10A is smaller than the amount of the refrigerant gas that flows from the high-pressure side flow path 41 into the pressure pocket 45.

[Floating Amount Restriction Mechanism]

The compressor 1 includes a mechanism restricting the floating amount of the orbiting scroll 30. As described below, the mechanism restricts the floating amount of the thrust plate 19 that receives the pressure of the refrigerant gas to float the orbiting scroll 30, thereby restricting the floating amount of the orbiting scroll 30.

Figure 3A:
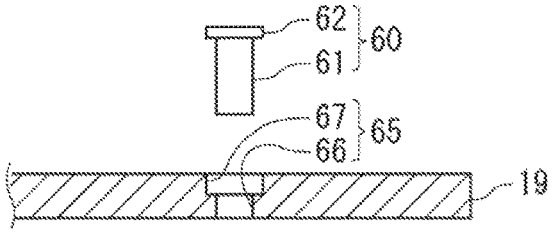
FIGS. 3A to 3C are diagrams illustrating a floating amount restriction mechanism according to the first embodiment, where

As illustrated in FIG. 1 and FIGS. 3A to 3C, the mechanism includes a restriction pin 60 that passes through the thrust plate 19 and has a front end fixed to the front housing 14. As illustrated in FIG. 3A, the restriction pin 60 includes, as components, a shaft part 61 and a head part 62 continuous with the shaft part 61. The head part 62 has a diameter larger than that of the shaft part 61. A cylindrical air gap 35 is provided on the orbiting end plate 31 at a position corresponding to the restriction pin 60.

As illustrated in FIG. 3A, the thrust plate 19 has a restriction hole 65 that passes through front and rear of the thrust plate 19 and into which the restriction pin 60 is inserted. The restriction hole 65 includes a small-diameter part 66 and a large-diameter part 67. The small-diameter part 66 has a diameter corresponding to the shaft part 61 of the restriction pin 60, and the large-diameter part 67 has a diameter corresponding to the head part 62 of the restriction pin 60.

Figure 3B:
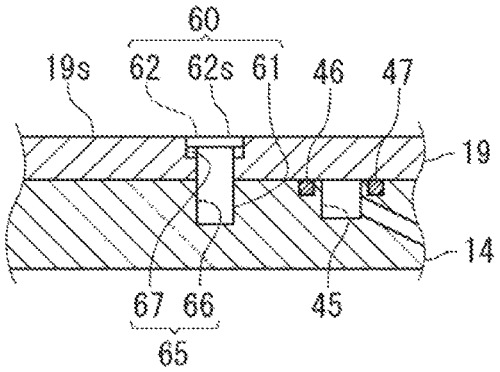
Figure 3C:
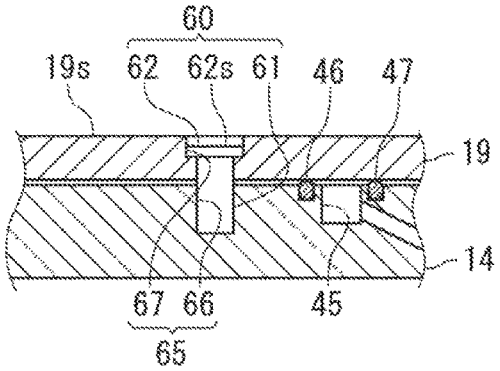
Figure 4:
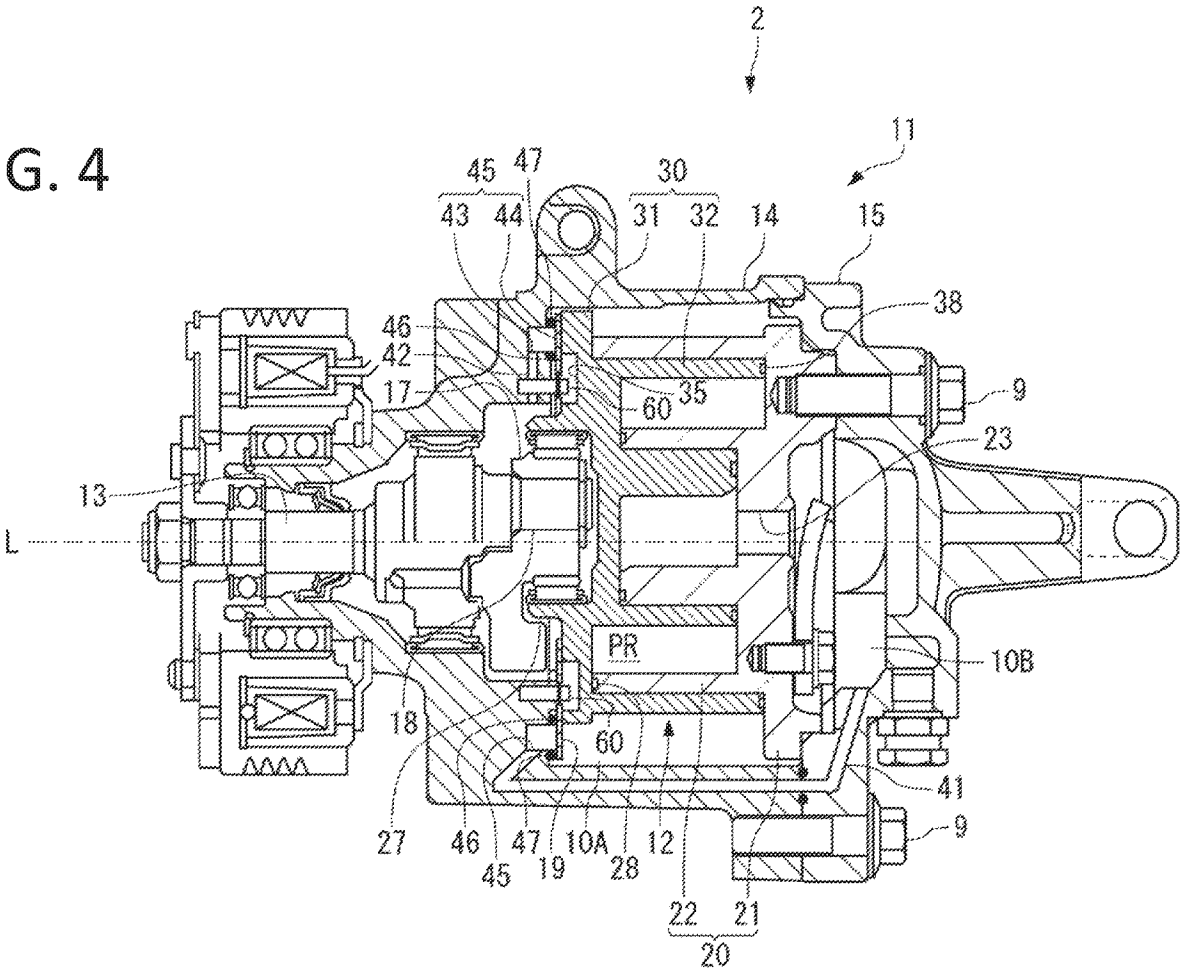
FIG. 4 is a vertical cross-sectional view of a scroll compressor according to a second embodiment.

As illustrated in FIG. 3B and FIG. 3C, the restriction pin 60 is inserted into the restriction hole 65 of the thrust plate 19, and the front end part of the restriction pin 60 is fixed to the front housing 14. Here, FIG. 3B is a diagram illustrating a state in which the thrust plate 19 does not float (the floating amount is zero) because the thrust plate 19 does not receive the back pressure. FIG. 3C is a diagram illustrating a state in which the back pressure is applied to the thrust plate 19 and the floating amount of the thrust plate 19 accordingly becomes the maximum. As illustrated in FIG. 3B and FIG. 3C, when receiving the back pressure, the thrust plate 19 floats; however, the head part 62 of the restriction pin 60 is locked to a step that is a boundary between the small-diameter part 66 and the large-diameter part 67, which restricts floating of the thrust plate 19 beyond the locked position. As mentioned above, the floating of the orbiting scroll 30 follows the floating of the thrust plate 19. Therefore, restricting the floating amount of the thrust plate 19 makes it possible to restrict the floating amount of the orbiting scroll 30.

In the present embodiment, as illustrated in FIG. 3B, a front surface 19S of the thrust plate 19 and a top surface 62S of the head part 62 of the restriction pin 60 may preferably form the same plane in the state where the floating amount of the thrust plate 19 is zero. This allows for specification of the floating amount of the thrust plate 19 by a value that is obtained by subtracting a thickness t of the head part 62 from a depth d of the large-diameter part 67, which facilitates control of the floating amount of the orbiting scroll 30.

Further, although one floating amount restriction mechanism configured of the pair of the restriction pin 60 and the restriction hole 65 is illustrated in FIGS. 3A, 3B, and 3C, two or more floating amount restriction mechanism may be provided in the present embodiment. For example, the floating amount restriction mechanism may be provided on each of positions denoted by P2 in FIG. 2. Note that, in FIG. 2, two positions P2 are symmetrical to each other.

[Operation of Compressor 1]

Next, the operation of the compressor 1 including the above-described configuration is described.

When a drive source is driven and the compressor 1 is accordingly driven, the main shaft 13 rotates, and the orbiting scroll 30 revolves relative to the fixed scroll 20 along with the rotation of the main shaft 13. As a result, the refrigerant gas is compressed in the compression chamber PR between the orbiting scroll 30 and the fixed scroll 20, and the refrigerant gas that has been introduced from an unillustrated suction pipe to the low pressure chamber 10A inside the housing 11 is sucked into a space between the orbiting scroll 30 and the fixed scroll 20. Then, the refrigerant gas that has been compressed in the compression chamber PR and put into the high temperature/high pressure state is discharged to the high pressure chamber 10B through the discharge port 23 of the fixed end plate 21.

Then, the discharged high pressure/high temperature refrigerant gas is discharged to the outside through an unillustrated discharge port. The suction, compression, and discharge of the refrigerant are sequentially performed in this manner.

A portion of the refrigerant gas discharged to the high pressure chamber 10B flows into the pressure pocket 45 through the high-pressure side flow path 41. The pressure pocket 45 is sealed by the thrust plate 19, the inner/outer sealing bodies 46 and 47, and the front housing 14, except for a connection part with the high-pressure side flow path 41 and the low-pressure side flow path 42. The high-pressure refrigerant gas that has flowed into the pressure pocket 45 applies, to the orbiting scroll 30 through the thrust plate 19, back pressure that presses the orbiting scroll 30 toward the fixed scroll 20, in the process of flowing inside the pressure pocket 45 along the circumferential direction, as described later. Since the opening area A2 of the low-pressure side flow path 42 is smaller than the opening area A1 of the high-pressure side flow path 41, predetermined pressure is loaded to the pressure pocket 45. The force pressing the orbiting scroll 30 depends on the pressure of the refrigerant gas discharged to the high pressure chamber 10B.

The refrigerant gas that has passed through the pressure pocket 45 is sucked from the low-pressure side flow path 42 into the low pressure chamber 10A, whereas the lubricant oil contained in the refrigerant gas is returned to the low pressure chamber 10A.

Hereinbefore, the case in which the refrigerant gas flows into the pressure pocket 45 is described; however, the lubricant oil contained in the refrigerant gas may flow into the pressure pocket 45.

In this case, an oil separation chamber is provided on the high pressure chamber 10B side, and the high-pressure side flow path 41 is provided on a bottom of the oil separation chamber.

The lubricant oil separated by the oil separation chamber flows to the bottom of the oil separation chamber by its own weight, and then flows into the pressure pocket 45 through the high-pressure side flow path 41. Pressure is applied to the lubricant oil from the refrigerant gas in the high pressure chamber 10B. Thus, the pressing force of the lubricant oil to the thrust plate 19 depends on the pressure of the refrigerant gas discharged from the compression chamber PR. The lubricant oil is returned to the low pressure chamber 10A through the low-pressure side flow path 42.

[Effects]

Next, action and effects of the compressor 1 having the above-described configuration are described.

The compressor 1 restricts the floating amount of the orbiting scroll 30 with use of the floating amount restriction mechanism that is configured of the restriction pin 60 and the restriction hole 65, during the high performance operation. This prevents the front end surfaces of the wraps 22 and 32 from being pressed against the end plates 31 and 21 on the respective counter sides by excessive force. Therefore, the compressor 1 makes it possible to secure reliability with respect to failure such as seizure of the tooth tops of the respective wraps 32 and 22, while performing the back-pressure control.

Further, the compressor 1 achieves restriction of the floating amount of the orbiting scroll 30 through restriction of the floating amount of the thrust plate 19. For example, a floating amount restriction mechanism similar to that of the present embodiment may be provided on the orbiting scroll 30; however, failure such as galling and seizure may occur between the orbiting scroll 30 and the restriction pin 60 due to sliding that inevitably occurs therebetween along with the orbiting motion of the orbiting scroll 30. In contrast, in the case where the mechanism is provided in the thrust plate 19 as with the present embodiment, it is possible to secure reliability with respect to the failure because the thrust plate 19 does not perform motion other than floating.

Further, in the compressor 1, the rotation preventing mechanism prevents the thrust plate 19 from being inclined when the thrust plate 19 floats, thereby contributing to stable floating of the thrust plate 19.

Second Embodiment

Next, a compressor 2 according to a second embodiment is described based on FIG. 4 and FIGS. 5A, 5B, and 5C.

In the second embodiment, a pin that is originally provided in the scroll compressor 2 to prevent rotation of the orbiting scroll 30 is replaced with the restriction pin 60 of the floating amount restriction mechanism. Since the compressor 2 has a configuration similar to that of the compressor 1 except for the above-described pin, the components same as those used in the first embodiment are denoted by the reference numerals in FIG. 4 and FIGS. 5A, 5B, and 5C same as those in FIG. 1 to FIGS. 3A, 3B, and 3C, and the compressor 2 is described below while focusing on differences with the compressor 1.

The compressor 2 includes a rotation preventing mechanism that prevents rotation of the orbiting scroll 30. The rotation preventing mechanism is provided at a position denoted by P1 in FIG. 2, and a pin-ring rotation preventing mechanism is adopted in the present embodiment.

As illustrated in FIG. 5, the rotation preventing mechanism includes the restriction pin (a rotation preventing pin) 60 fixed to the front housing 14, and a rotation preventing ring 68 provided in the orbiting scroll 30.

Figure 5A:
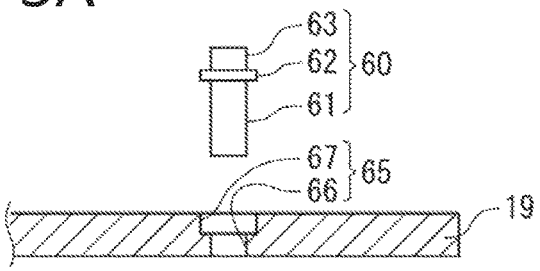
FIGS. 5A to 5C are diagrams illustrating a floating amount restriction mechanism according to the second embodiment, where

The restriction pin 60 is different from that of the first embodiment in that the restriction pin 60 of the present embodiment includes a rotation preventing pin part 63 in addition to the shaft part 61 and the head part 62 as illustrated in FIG. 5A.

Figure 5B:
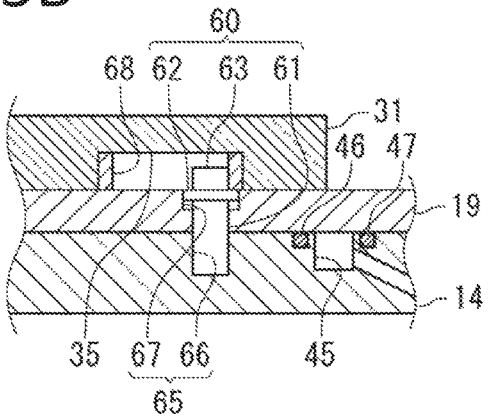

As illustrated in FIG. 5B, the thrust plate 19 includes the restriction hole 65 that passes through the front and rear of the thrust plate 19 and into which the restriction pin 60 is inserted. The restriction hole 65 is configured of the small-diameter part 66 and the large-diameter part 67, as with the first embodiment.

The rotation preventing ring 68 is fitted to the cylindrical air gap 35 that is formed on a thrust surface on the rear surface side of the orbiting end plate 31 of the orbiting scroll 30.

Figure 5C:
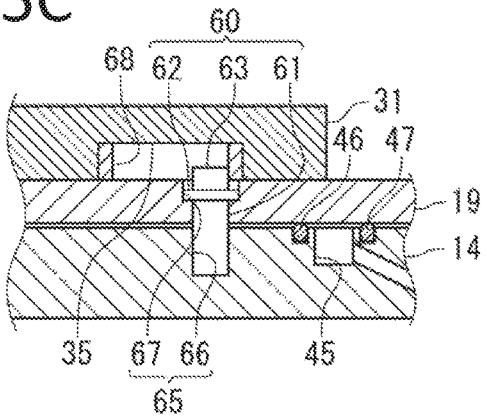

As illustrated in FIG. 5B and FIG. 5C, the restriction pin 60 is inserted into the restriction hole 65 of the thrust plate 19, and the front end side thereof is fixed to the front housing 14. The rotation preventing pin part 63 is provided to project from the surface of the thrust plate 19 to the inside of the air gap 35.

As with the first embodiment, FIG. 5B is a diagram illustrating the state in which the floating amount of the thrust plate 19 is zero, and FIG. 5C is a diagram illustrating the state in which the floating amount of the thrust plate 19 is the maximum. As illustrated in FIGS. 5B and 5C, the head part 62 of the restriction pin 60 is locked to the step that is the boundary between the small-diameter part 66 and the large-diameter part 67, which restricts the floating amount of the orbiting scroll 30. In this process, the rotation preventing pin part 63 of the restriction pin 60 revolves along an inner wall surface of the rotation preventing ring 68, thereby preventing the rotation of the orbiting scroll 30. Accordingly, the orbiting scroll 30 may revolve relative to the fixed scroll 20.

[Effects]

The compressor 2 includes the action and effects similar to those of the compressor 1 according to the first embodiment and exhibits the following effects as well.

It is unnecessary for the compressor 2 to include a dedicated restriction pin for restriction of the floating amount because the compressor 2 uses the rotation preventing pin provided in the scroll compressor to restrict the floating amount of the orbiting scroll 30. Accordingly, the number of components of the compressor 2 may be reduced as compared with the first embodiment, which contributes to cost reduction.

Further, since the part where the dedicated restriction pin 60 passes through the thrust plate 19 cannot receive the back pressure, the area of the thrust plate 19 receiving the back pressure is decreased when the dedicated restriction pin 60 is provided. In contrast, using the rotation preventing pin as with the compressor 2 eliminates reduction of the back-pressure area by the dedicated restriction pin 60. This makes it possible to expand the back-pressure area as compared with the first embodiment.

Third Embodiment

Figure 6:
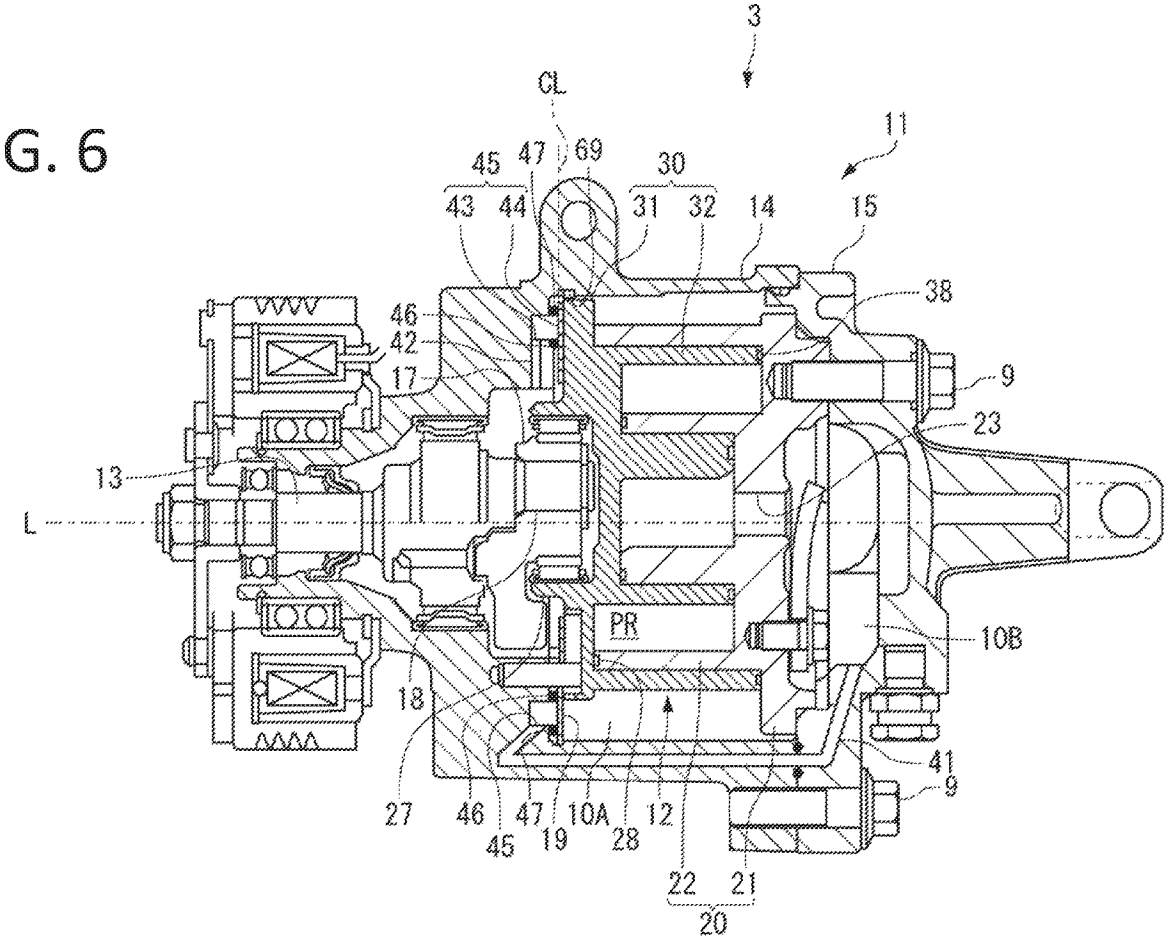
FIG. 6 is a vertical cross-sectional view of a scroll compressor according to a third embodiment.
Figure 7A:
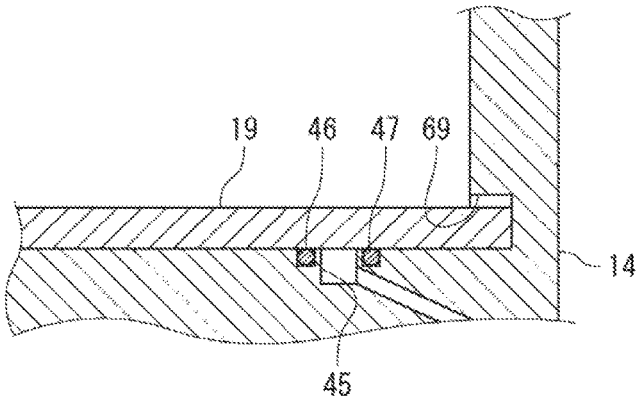
FIGS. 7A and 7B are diagrams illustrating a floating amount restriction mechanism according to the third embodiment, where
Figure 7B:
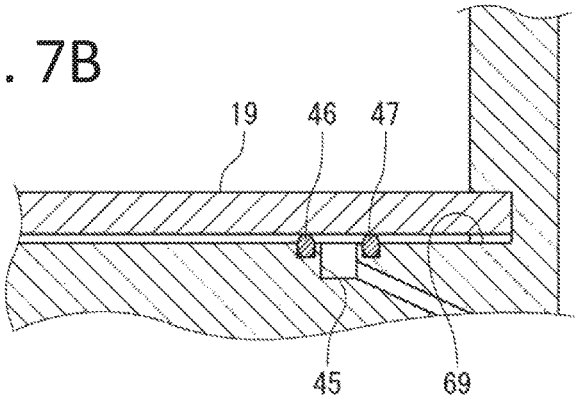

Next, a compressor 3 according to a third embodiment is described based on FIG. 6 and FIGS. 7A and 7B.

In the third embodiment, the thrust plate 19 is locked to the housing to restrict the floating amount of the orbiting scroll 30 through the thrust plate 19. Although the compressor 3 includes a configuration necessary therefor, the basic configuration of the compressor 3 as the scroll compressor is similar to that of the compressor 1. Therefore, the components same as those of the compressor 1 are denoted by the reference numerals in FIG. 6 and FIGS. 7A and 7B same as those in FIG. 1 to FIGS. 3A, 3B, and 3C, and the compressor 3 is described below while focusing on differences with the compressor 1.

As illustrated in FIG. 6 and FIGS. 7A and 7B, in the compressor 3, the diameter of the thrust plate 19 is expanded up to an extent interfering the inner wall surface of the front housing 14. On the other hand, a restriction groove 69 that recedes from the inner wall surface in the thickness direction is provided in a region, of the front housing 14, corresponding to the floating range of the thrust plate 19. The restriction groove 69 is formed in a ring shape continuously to the circumferential direction of the inner wall surface. The peripheral edge part of the thrust plate 19 is inserted into the restriction groove 69, which restricts the floating amount of the thrust plate 19.

Here, FIG. 7A is a diagram illustrating the state in which the floating amount of the thrust plate 19 is zero, and FIG. 7B is a diagram illustrating the state in which the floating amount of the thrust plate 19 is the maximum.

As illustrated in FIGS. 7A and 7B, when receiving the back pressure, the thrust plate 19 floats; however, the peripheral edge of the thrust plate 19 is locked to an upper wall of the restriction groove 69, which restricts floating of the thrust plate 19 up to the locked position. In this way, the compressor 3 causes the thrust plate 19 and the front housing 14 to lock to each other, thereby restricting the floating amount of the orbiting scroll 30.

In this case, the dimension (the depth) receded from the inner wall surface and the dimension (the width) in the axial direction of the restriction groove 69 are optional as long as the restriction groove 69 achieves the restriction of the floating amount mentioned above.

Moreover, it is assumed that the restriction groove 69 is formed continuously to the entire region in the circumferential direction and the entire peripheral edge of the thrust plate 19 is inserted into the restriction groove 69. The restriction groove 69, however, may be optionally provided intermittently in the circumferential direction, and the expanded part of the diameter of the thrust plate 19 that is to be inserted into the restriction groove 69 may be optionally provided intermittently according to the restriction groove 69, as long as the restriction of the floating amount mentioned above is achieved.

[Effects]

The compressor 3 has the effects similar to those of the compressor 1 according to the first embodiment and exhibits the following effects as well.

The compressor 3 causes the thrust plate 19 and the front housing 14 to lock to each other, thereby restricting the floating amount of the orbiting scroll 30. Therefore, it is unnecessary for the compressor 3 to include the dedicated restriction pin for restriction of the floating amount. This makes it possible to achieve cost reduction by the reduction of the number of components, as compared with the first embodiment.

Further, since it is unnecessary for the compressor 3 to include the dedicated restriction pin 60, it is possible to expand the back-pressure area as with the second embodiment, as compared with the first embodiment.

Moreover, since the compressor 3 locks the entire peripheral edge of the thrust plate 19 by the restriction groove 69, it is possible to reduce variation of the floating amount in the circumferential direction when the floating amount of the thrust plate 19 becomes the maximum. This makes it possible to prevent the orbiting scroll 30 from being inclined in the axial direction and to secure stable floating when the orbiting scroll 30 floats through the thrust plate 19. Furthermore, the peripheral edge of the thrust plate 19 is locked to the restriction groove 69, which exerts a function of preventing the thrust plate 19 from rotating in the circumferential direction.

In the third embodiment in which the thrust plate 19 is locked to the housing, formation of the restriction groove 69 with high accuracy is important for strictly controlling the floating amount of the orbiting scroll 30. Since the restriction groove 69 described above is located on the bottom of the front housing 14 as illustrated in FIG. 6, it is difficult to perform mechanical processing of the restriction groove 69 with high accuracy. Thus, as illustrated in FIG. 6, the housing is divided into two members different from each other at a boundary CL corresponding to the restriction groove 69, which facilitates the processing of the restriction groove 69. In this case, a part that corresponds to the front housing 14 located on right side of the boundary CL in the drawing and the fixed scroll 20 are integrally formed. Then, the integrated structure is abutted on a part that corresponds to the front housing 14 located on left side of the boundary CL in the drawing, at the boundary CL. When the third embodiment is applied to this three-piece scroll compressor, it is possible to easily form the restriction groove 69 with high accuracy.

Although the preferred embodiments of the present invention are described hereinbefore, the configurations described in the above-described embodiments may be selected or may be appropriately modified without departing from the scope of the present invention.

It is sufficient for the present invention to include the part that presses the orbiting scroll 30. Therefore, although the concave part 44 is provided on the front housing 14 in the present embodiment, the concave part 44 may be provided in the thrust plate 19.

The front surface side of the orbiting end plate 31, however, may have a complicated form in relation to the peripheral members. Therefore, providing the thrust plate 19 makes it possible to form the concave part 44 on the same plane. This allows for pressing of the orbiting scroll with uniform force.

REFERENCE SIGNS LIST

1, 2, 3 Scroll compressor (compressor)
9 Fasting member
10A Low pressure chamber
10B High pressure chamber
11 Housing
12 Compression mechanism
13 Main shaft
14 Front housing
15 Rear housing
17 Eccentric bushing
18 Eccentric pin
19 Thrust plate
19S Front surface
20 Fixed scroll
21 Fixed end plate
22 Wrap
23 Discharge port
27 Boss
28 Chip seal
30 Orbiting scroll
31 Orbiting end plate
31A Inner circumferential bottom part
31B Outer circumferential bottom part
31C Step part
32 Wrap
32A Inner circumferential wrap
32B Outer circumferential wrap
32C Step part
35 Air gap
38 Chip seal
41 High-pressure side flow path
42 Low-pressure side flow path
43 Communication passage
44 Concave part
45 Pressure pocket
46 Inner sealing body
47 Outer sealing body
60 Restriction pin
61 Shaft part
62 Head part
62S Top surface
63 Rotation preventing pin part
65 Restriction hole
66 Small-diameter part
67 Large-diameter part
68 Rotation preventing ring
69 Restriction groove

The invention claimed is:

1. A scroll compressor, comprising:

a scroll compression mechanism including an orbiting scroll, a fixed scroll, and a thrust plate, the fixed scroll facing the orbiting scroll to form a compression chamber, the compression chamber compressing refrigerant gas, and the thrust plate supporting a load of the orbiting scroll in a thrust direction;

a back-pressure application mechanism that applies, as back pressure, the refrigerant gas compressed by the scroll compression mechanism to a rear surface of the thrust plate;

a floating amount restriction mechanism that restricts an amount of floating of the thrust plate caused by the back pressure; and a housing that houses the scroll compression mechanism, the back-pressure application mechanism, and the floating amount restriction mechanism, wherein the floating amount restriction mechanism includes a restriction pin that includes a shaft part and a head part and locks the thrust plate to the head part to restrict the amount of floating, the shaft part penetrating through the thrust plate and having a front end part fixed to the housing, and the head part being continuous to the shaft part and having a diameter larger than a diameter of the shaft part.

2. The scroll compressor according to claim 1, wherein the head part is locked to a step of a restriction hole that penetrates through the thrust plate and into which the restriction pin is inserted.

3. The scroll compressor according to claim 1, further comprising a rotation preventing mechanism that prevents rotation of the orbiting scroll, the rotation preventing mechanism including a pin and a ring, wherein the pin of the rotation preventing mechanism functions as the restriction pin.

4. The scroll compressor according to claim 1, wherein an abradable coating is provided on a front end surface of one or both of a wrap provided in the orbiting scroll and a wrap provided in the fixed scroll.

5. A scroll compressor, comprising:

a scroll compression mechanism including an orbiting scroll, a fixed scroll, and a thrust plate, the fixed scroll facing the orbiting scroll to form a compression chamber, the compression chamber compressing refrigerant gas, and the thrust plate supporting a load of the orbiting scroll in a thrust direction;

a back-pressure application mechanism that applies, as back pressure, the refrigerant gas compressed by the scroll compression mechanism to a rear surface of the thrust plate;

a floating amount restriction mechanism that restricts an amount of floating of the thrust plate caused by the back pressure; and a housing that houses the scroll compression mechanism, the back-pressure application mechanism, and the floating amount restriction mechanism, wherein the floating amount restriction mechanism restricts the amount of floating through locking of a peripheral edge of the thrust plate to an inner circumferential wall of the housing; wherein the inner circumferential wall of the housing includes a groove that recedes from a surface of the inner circumferential wall in a thickness direction, and the peripheral edge of the thrust plate is inserted into the groove so as to be locked to the inner circumferential wall of the housing.

6. The scroll compressor according to claim 5, wherein the groove includes an upper wall and a lower wall facing the upper wall, and the floating amount restriction mechanism is configured such that the peripheral edge of the thrust plate is supported on the lower wall when a floating amount of the thrust plate is zero.

7. The scroll compressor according to claim 5, wherein an abradable coating is provided on a front end surface of one or both of a wrap provided in the orbiting scroll and a wrap provided in the fixed scroll.

* * * * *